United States Patent [19]

Miwa

[11] Patent Number: 4,664,182

[45] Date of Patent: May 12, 1987

[54] HYDROPHILIC FINS FOR A HEAT EXCHANGER

[75] Inventor: Kazuharu Miwa, Chigasaki, Japan

[73] Assignee: Tokai Metals Co., Ltd., Kanagawa, Japan

[21] Appl. No.: 703,603

[22] Filed: Feb. 21, 1985

[30] Foreign Application Priority Data

Mar. 28, 1984 [JP] Japan ..... 59-059896

[51] Int. Cl.[4] ..... F28F 13/18; F28F 19/02

[52] U.S. Cl. ..... 165/133; 165/913; 62/272; 29/157.3 R

[58] Field of Search ..... 165/133; 62/272; 428/459, 461; 29/157.3 R; 427/414, 435, 384

[56] References Cited

U.S. PATENT DOCUMENTS 2,505,734 4/1950 Freud ..... 428/459
3,958,058 5/1976 Stauner et al. ..... 427/414
4,172,164 10/1979 Meyer et al. ..... 165/10 X
4,200,680 4/1980 Sasazawa et al. ..... 428/403
4,241,682 12/1980 Konstandt ..... 428/461
4,421,789 12/1983 Kaneko et al. ..... 165/133
4,503,907 3/1985 Tanaka et al. ..... 165/133

*Primary Examiner*—Albert W. Davis, Jr.
*Assistant Examiner*—Richard R. Cole
*Attorney, Agent, or Firm*—Parkhurst & Oliff

[57] ABSTRACT

A fin for a heat exchanger which is highly hydrophilic and rustproof comprises a substrate of aluminum or an aluminum alloy having thereon a hydrophilic coat including therein a proteinaceous substance having a peptide bond, e.g., gelatin. Further enhancement of the fin's affinity for water is obtained by using a hydrophilic coat prepared by mixing a water soluble coating material, such as acrylic paint, with the proteinaceous substance. The coat is made by applying a water-based coating composition including the proteinaceous substance to a substrate and drying it in the temperature range of 100° to 250° C., and preferably 180° to 220° C.

18 Claims, 4 Drawing Figures

HYDROPHILIC FINS FOR A HEAT EXCHANGER

BACKGROUND OF THE INVENTION

This invention relates to fins for a heat exchanger which have been treated to be hydrophilic.

Heat exchangers of various types have been used in a wide range of applications including room air conditioners, car air conditioners and air conditioners incorporating space coolers and heaters, for example. These heat exchangers are made preponderantly of aluminum and aluminum alloys. As illustrated in FIGS. 1 and 2, they generally comprise a zigzagging tube 1 for carrying a coolant, refrigerant or the like and a multiplicity of fins 2 disposed substantially in parallel to one another around the tube. In the diagrams, 2' denotes a protective plate.

When the surface temperature of the fins 2 and the coolant tube 1 falls below the dew point while the cooler is in operation, dew adheres to the surfaces of the fins and coolant tube. At times, the dew corrodes fins of aluminum or aluminum alloy, producing a white corrosion product (consisting of aluminum hydroxide and other compounds). The surfaces of the fins therefore normally are provided with a rustproofing layer, for example, by a chromate-treatment or, in recent years, a resin coat or a silicate coat.

To reduce size and improve performance, the designs for heat exchangers of this class of late have employed increasing numbers of fins and, therefore, have had an ever increasing available area of contact between the incoming air and the fins. For the same reasons, the space separating the fins is being reduced to the greatest extent possible without increasing the resistance to air flow between the fins.

When the rustproofing layer mentioned above is hydrophobic, the dew adhering to the fins collects into hemispheres or spheres, which may grow until they reach the adjacent fins. When the dew reaches to the adjacent fins in this fashion, it can continue to collect by capillary action, clogging the spaces between the fins, as illustrated in FIG. 3. This phenomenon is called bridging. In FIG. 3, reference numeral 3 denotes a dew bead which has developed the bridging phenomenon, and 3' two dew beads which have yet to reach this stage.

When the dew induces this bridging phenomenon, the resistance offered by the fins to the passing current of air increases notably, the heat-exchange ratio consequently is lowered and the cooling capacity of the heat exchanger degraded. The fins, therefore, should possess a hydrophilic surface.

The methods proposed to date for imparting a hydrophilic surface to the fins include forming thereon a coating containing a surfactant such as polyoxyethylene nonylphenyl ether on the surfaces of the fins, coating the surfaces of the fins with colloidal silica or water glass, and subjecting the surfaces of the fins to a post boehmite-treatment, for example. The coating containing the surfactant shows insufficient affinity for water and inevitably induces the bridging phenomenon. The coating of colloidal silica or water glass is so rigid that the press die and cutter used in fabricating the fins become seriously worn. Moreover, since this coat is as brittle as glass, the surfaces of the fins (particularly the surfaces of the flange portions) are liable to sustain cracks, fissures and the like during the course of fabrication. The trend toward such heavy wear and cracking is particularly conspicuous when the film is made of colloidal silica. Finally, the boehmite-treatment is not economical because of very high cost.

SUMMARY OF THE INVENTION

An object of this invention is to provide fins for a heat exchanger which have a high affinity for water and therefore inhibit the aforementioned bridging phenomenon due to dew.

Another object of this invention is to provide fins which excel in rustproofness.

Yet another object of this invention is to provide fins which are highly machinable during fabrication (by pressing, punching, etc.).

A further object of this invention is to provide fins possessing the aforementioned excellent properties inexpensively.

These objectives are accomplished according to the present invention by providing a fin having a hydrophilic coat containing a specific substance on the surfaces of fin substrates, preferably made of aluminum or an aluminum alloy. To be specific, the fins of a heat exchanger according to the present invention have formed on their surfaces a hydrophilic coat comprising a proteinaceous substance having a peptide bond, and, optionally, other substances such as a water soluble coating material and a surfactant.

This invention further is directed to a method for the manufacture of a heat exchanger, which comprises forming a hydrophilic coat on the surfaces of fin substrates by applying thereto a water-based coating composition comprising the aforementioned proteinaceous substance and, optionally, other substances such as a water soluble coating material and a surfactant.

The other objects and characteristic features of the present invention will become apparent to those skilled in the art from the following description of a preferred embodiment of the invention, as illustrated in the accompanying drawings.

DETAILED DESCRIPTION OF THE INVENTION

This invention provides fins and a method for making fins with an improved affinity for water and easy machinability by forming on the surface of fin substrates a coat comprising a proteinaceous substance having a peptide bond (>C=O . . . HN<).

According to further aspects of the invention, the hydrophilic coating further may comprise water soluble substances such as a water soluble acrylic resin and/or a nonionic surfactant.

Any proteinaceous substance having at least one of the aforementioned peptide bonds can be adopted as the proteinaceous substance to be used in this invention. Concrete examples are gelatin, casein or proteinaceous substances containing plentiful L-proline or L-oxyproline. Of the proteinaceous substances cited above, gelatin proves particularly desirable.

The fins of this invention now will be described. For the sake of simplicity of description, use of gelatin as the proteinaceous substance is presumed in the following description. The discussion below concerning the amount of gelatin to be applied, the gelatin content of the water-based coating composition, etc., applies equally well to the other proteinaceous substances mentioned above.

Figure 4:
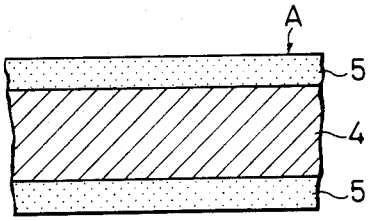
FIG. 4 is a magnified sectional view illustrating a typical fin of a heat exchanger in accordance with the present invention.

As illustrated in FIG. 4, the fin A of this invention typically is formed by applying to the surface of a sheet or foil substrate 4 (about 0.1 to 0.3 mm in thickness) made of aluminum or an aluminum alloy a hydrophilic coat 5 of gelatin. The gelatin coat 5 is wetted readily with water. When a drop of water falls on the surface of the coat 5, it spreads out into a flat sheet. Moreover, the gelatin coat 5 enjoys much higher flexibility than a coat of colloidal silica or water glass, as well as high adhesiveness to the substrate 4 of aluminum.

Although the amount of the coat 5 so applied to the substrate may be selected freely, preferably the gelatin solids content of the applied coat 5 will not exceed 2 $g/m^2$. When this solids content is too large, the heat-exchange ratio is lowered and the cooling capacity of the cooler or air conditioner consequently is degraded.

The formation of this coat can be accomplished advantageously by first defatting the surface of the substrate 4 with trichloroethane, for example, then applying an aqueous gelatin solution to the surface of the substrate 4, for example, with a brush, thereby forming a gelatin layer thereon, and thereafter drying the applied layer of aqueous solution. Using this technique, the aqueous gelatin solution can be handled conveniently when the gelatin content thereof is kept below 10%. Preferably, the gelatin content is in the range of 4 to 6%. If the gelatin content exceeds 10%, the aqueous gelatin solution becomes too viscous to be applied with high uniformity. When the gelatin content is below 10%, the aqueous gelatin solution possesses adequate viscosity and allows smooth application to the substrate.

The applied layer of the aqueous gelatin solution must be dried at a temperature in the range of 100° to 250° C., and preferably 180° to 220° C. If the temperature is below 100° C., the gelatin fails to adhere to the surface of the substrate with ample fastness. When the fin then is immersed in water, the gelatin so adhering with insufficient fastness swells and dissolves out into the water. When the temperature falls in the range specified above, the gelatin coat will not dissolve out into water and provides high waterproofness to the fin. If the temperature exceeds 250° C., however, the heat scorches the gelatin coat.

Figure 1:
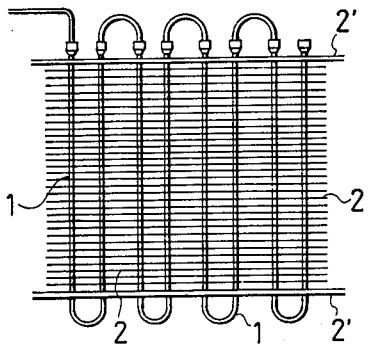
FIG. 1 is a side view of a heat exchanger for illustrating the manner in which fins are attached thereto.
Figure 3:
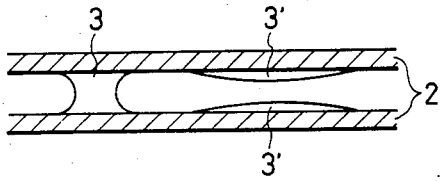
FIG. 3 is a sectional view illustrating the formation of dew in a space between two fins.
Figure 2:
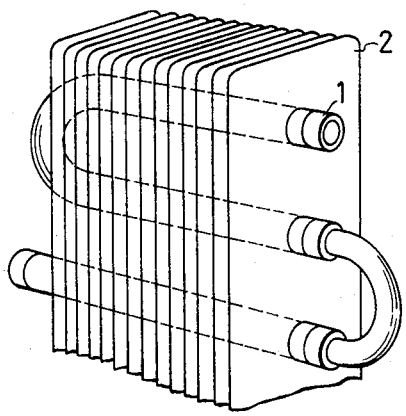
FIG. 2 is a perspective view illustrating part of the heat exchanger of FIG. 1.

The fin 3 of this invention on which the coat 5 has been formed as described above then is finished into the desired shape by cutting and pressing. By joining as many finished fins as desired, a heat exchanger of the appearance of FIG. 1 can be produced.

The hydrophilic coat contemplated by this invention may be formed of a water-based coating composition containing only the aforementioned proteinaceous substance such as, for example, gelatin, but also may contain therein a surfactant or other additives. The hydrophilic coat so produced retains the properties of the gelatin intact and offers a notably enhanced rustproofing capacity as compared with the simple gelatin coat described above. Any of the water soluble coating materials available commercially today, including acrylic paints, also can be added to the water-based coating composition. However, since gelatin has very little affinity for oils, it cannot be blended well with oily paints. The solids content of the coat so formed again preferably should not be more than 2 $g/m^2$, for the same reasons as given above. Preferably, the proportion of gelatin in the solids content of the coat should fall in the range of 5 to 15%, and more preferably 7 to 12%. Even if the proportion of gelatin is very small, the gelatin coat still is hydrophilic. When the proportion falls in the range specified above, however, the affinity for water and the rustproofing properties are particulary good and well balanced.

The formation of this hydrophilic coat can be accomplished advantageously, for example, by mixing an aqueous gelatin solution with a water soluble coating material, applying the resultant mixed solution to the surface of the substrate of aluminum, for example, and thereafter drying the applied layer of the mixed solution. In this case, the proportions of the aqueous gelatin solution and the water soluble coating material can be selected freely. The applied layer of the mixed solution preferably should be dried under the same conditions as described above.

Working examples of this invention now will be described.

An aqueous gelatin solution (gelatin content 5%), a gelatin-acrylic paint mixed solution (gelatin/paint solids=½), and two gelatin-acrylic paint mixed solutions (gelatin/paint solids=½ and 2/1) each containing 0.5% of a nonionic surfactant (polyoxyethelene nonylphenyl ether) were applied to aluminum alloy substrates. The applied layers were dried at temperatures in the range of 180° to 220° C. to produce the fins of Examples 1, 2, 3, and 4. For comparison, an acrylic paint containing 0.5% of the same nonionic surfactant and an acrylic paint containing 40% colloidal silica were applied to the same substrates as described above and then dried under the same conditions to produce the fins of Comparative Experiments 1-2.

The fins so produced were subjected to an atomizer test and a contact angle test to determine affinity for water. In the atomizer test, water was sprayed on test pieces at room temperature (with an atomizer) and the test pieces observed to determine whether water drops were formed on their surface. In the contact angle test, a drop of distilled water was placed on each test piece with a pipette and the contact angle of the drop was observed under a microscope. Two samples each of these fins were tested, one first being immersed in press oil (machine oil/kerosene=1/1) and washed with trichloroethylene at 80° C. (corresponding to the conditions involved during shop fabrication) and the other first left standing in running water for 7 hours and dryed at room temperature for 17 hours in a total of ten cycles (corresponding to the conditions under which fins are actually used), to test for initial and lasting affinity for water.

The fins also were subjected to a salt spray test and a humidity test to determine rustproofness. The salt spray test was conducted in accordance with JIS (Japanese Industrial Standards) Z-2371 for 300 hours, and the samples were rated for rustproofness after the test. The humidity test was conducted in accordance with JIS H-4001 for 500 hours, and the samples were rated for rustproofness after the test.

The results of these tests are shown in Table 1 below. It is noted from the table that the fins of the working examples retain high affinity for water over long periods. It is further noted that coats of a mixture of gelatin and acrylic paint impart notably improved rustproofing ability to the fins. The addition of a surfactant further enhances the affinity for water.

TABLE 1

| Fin of | Hydrophilic coat | Initial affinity for water | | Lasting affinity for water | | Salt spray test | Humidity test |
|---|---|---|---|---|---|---|---|
| | | Contact Angle | Atomizer | Contact Angle | Atomizer | | |
| Ex. | | | | | | | |
| 1 | Gelatin | 10° | 0 | 60° | 0 | X | X |
| 2 | Gelatin/acrylic paint = 1/2 | 30° | 0 | 80° | 0 | 0 | 0 |
| 3 | Gelatin/acrylic paint = 1/2 (containing surfactant) | 14° | 0 | 75° | 0 | 0 | 0 |
| 4 | Gelatin/acrylic paint = 2/1 (containing surfactant) | 14° | 0 | 75° | 0 | X | X |
| C.E. | | | | | | | |
| 1 | Acrylic paint (containing surfactant) | 14° | 0 | 80° | X | 0 | 0 |
| 2 | Acrylic paint (containing colloidal silica) | 60° | 0 | 80° | 0 | Δ | Δ |

Ex. = Example
C.E. = Comparative Experiment
Remarks:
Scale of rating for atomizer test:
0 = Wetted
X = Not wetted
Scale of rating for salt spray test and humidity test:
0 = Area of corrosion less than 5%.
Δ = Area of corrosion about 5%.
X = Area of corrosion far more than 5%.

It has been confirmed that the desirable results shown in Table 1 similarly are obtained when casein or proteinaceous substances containing plentiful L-proline or L-oxyproline are used in the place of gelatin.

As described above, the fins of the heat exchanger of this invention possess high affinity for water and are readily wetted with water because they have formed on the surface of their substrates a coat comprising the aforementioned proteinaceous substance. When the fins of the construction described above are finished to a desired shape and incorporated in a heat exchanger, they will not induce the bridging phenomenon and consequently will not suffer from an impaired heat-exchange ratio while the heat exchanger is in service. Since the coat comprising the aforementioned proteinaceous substance is far more flexible than colloidal silica or water glass, the fins covered with this coat wear the press die only minimally during fabrication. The coat itself does not readily produce cracks, fissures and the like on its surface. Thus, the fins enjoy high machinability and good economy. The formation of the hydrophilic coat incorporating therein a water soluble coating material in conjunction with the aforementioned proteinaceous substance contributes immensely to enhancing the rustproofing of the fin substrates.

What is claimed is:

1. A heat exchanger fin comprising:
a metallic substrate;
a hydrophilic coating on a surface of the substrate comprising a proteinaceous substance having a peptide bond and a water soluble coating material.

2. A fin according to claim 1, wherein said metallic substrate comprises a metal selected from the group consisting of aluminum and aluminum alloys.

3. A fin according to claim 2, wherein said proteinaceous substance is selected from the group consisting of gelatin, casein and proteinaceous substances containing L-proline or L-oxyproline.

4. A fin according to claim 2, wherein said proteinaceous substance is gelatin.

5. A fin according to claim 2, wherein the proportion of solids of the proteinaceous substance comprise substantially 5 to 15 percent of the solids of the hydrophilic coating.

6. A fin according to claim 2, wherein the hydrophilic coating on the surface of the substrate has a solids content of not substantially more than 2 g/m$^2$.

7. A fin according to claim 1, wherein said water soluble coating material comprises an acrylic paint.

8. A fin according to claim 1, wherein said hydrophilic coating further comprises a nonionic surfactant.

9. A fin according to claim 8, wherein said surfactant comprises polyoxyethylene nonylphenyl ether.

10. A fin according to claim 1, wherein the ratio between solids of the proteinaceous substance and solids of the water soluble coating material is substantially 1 to 2.

11. A method for manufacturing a fin for a heat exchanger, comprising:
obtaining a metallic substrate;
applying a water-based coating composition comprising a proteinaceous substance having a peptide bond and a water soluble coating material to a surface of the substrate, thereby forming a hydrophilic coating thereon.

12. A method according to claim 11, wherein the metallic substrate is selected from the group consisting of aluminum and aluminum alloys.

13. A method according to claim 12, wherein said water-based coating composition comprises an aqueous gelatin solution.

14. A method according to claim 12, wherein said water-based coating composition further comprises an acrylic paint.

15. A method according to claim 12, wherein said water-based coating composition further comprises a nonionic surfactant.

16. A method according to claim 12, wherein said proteinaceous substance is selected from the group consisting of gelatin, casein and proteinaceous substances containing L-proline or L-oxyproline.

17. A method according to claim 16, wherein, after application, the water-based coating composition is dried at a temperature substantially in the range of 100° to 250° C.

18. A method according to claim 17, wherein said temperature is substantially in the range of 180° to 220° C.

* * * * *